United States Patent [19]

Dente et al.

[11] Patent Number: 4,552,777

[45] Date of Patent: Nov. 12, 1985

[54] CARPET TREATING COMPOSITIONS CONTAINING A POLYSILOXANE TO REDUCE CAKING

[75] Inventors: Stephen V. Dente, Emerson; Kenneth J. Ward, Dumont, both of N.J.

[73] Assignee: Airwick Industries, Inc., Carlstadt, N.J.

[21] Appl. No.: 669,506

[22] Filed: Nov. 8, 1984

[51] Int. Cl.[4] ..... C11D 7/12; C11D 7/60; C11D 17/06

[52] U.S. Cl. ..... 427/393.1; 252/8.6; 252/88; 252/135; 252/174; 252/174.11; 252/174.14; 252/174.15; 252/383; 252/384; 252/385; 427/393.4

[58] Field of Search ..... 252/174.15, 88, 174.11, 252/174.14, 174, 135, 383, 384, 385, 8.6; 427/393.1, 393.4; 8/137

[56] References Cited

U.S. PATENT DOCUMENTS

| | | | |
|---|---|---|---|
| 4,161,449 | 7/1979 | Smith | 252/8.6 |
| 4,244,834 | 1/1981 | Schwalley | 252/106 |
| 4,261,849 | 4/1981 | Benjaminson | 252/106 |
| 4,264,465 | 4/1981 | Abel | 252/99 |
| 4,304,675 | 12/1981 | Corey | 252/8.6 |
| 4,395,347 | 7/1983 | McLaughlin | 252/139 |

*Primary Examiner*—Dennis L. Albrecht
*Attorney, Agent, or Firm*—Harry Falber

[57] ABSTRACT

A powdered carpet composition comprising a blend of an inorganic salt carrier, an agglomerating agent, a fragrance and a polysiloxane material, said composition exhibiting anti-caking and fragrance retention properties and being in proper form for ready application to and removal from carpets so as to provide deodorizing and freshening effects thereto.

20 Claims, No Drawings

CARPET TREATING COMPOSITIONS CONTAINING A POLYSILOXANE TO REDUCE CAKING

Powdered carpet compositions intended primarily to deodorize and freshen carpets are a relatively new class of product. These products generally contain blends of inorganic salt carriers, agglomerating agents, anti-static agents and fragrance. This class of product was a response to the need for eliminating undesirable and lasting odors in carpets, namely, the musty or foul odors that result from excess humidity, soil, tobacco, and the like. Such products have been disclosed in U.S. Pat. No. 4,161,449 and U.S. Pat. No. 4,304,675.

The compositions of U.S. Pat. No. 4,161,449 have shown to particular advantage. They exhibit a powdered appearance without being overly dusty. They can be readily applied to carpets and in view of their agglomerated form, will tend to sit on top of the carpet fibers rather than sifting down through the fibers to the carpet base. In this manner, the blends can be readily removed from the carpet by vacuuming without reducing the efficiency of the vacuuming operation, as by clogging of the system. It is particularly this latter characteristic that represented a significant improvement over previously available carpet-treating formulations.

With regard to the characteristics imparted to the carpet, the fragrance provides deodorizing and freshening properties, which are also imparted to the vacuum cleaner and the surrounding atmosphere by the vacuuming process. Thus, musty and other disagreeable odors are removed from the carpet. Additives can be included which reduce static cling, soil retention and soil redeposition. It is seen, therefore, that the formulations exhibit both immediate and residual effectiveness.

Such products have, however, exhibited certain deficiencies when encountering areas of moisture in the carpet. Such moisture stemming from liquid spills, pet accidents, and the like, has tended to hydrolyze the product and to cause it to cake and adhere to the carpet. Accordingly, adverse effects in terms of undesirable carpet appearance, poor vacuum removal and reduced deodorization are encountered.

It is, therefore, the primary object of this invention to provide powdered carpet formulations which exhibit improved performance characteristics relative to the prior art materials.

It is a further object to provide such formulations which exhibit the same excellent performance characteristics under either dry or moist conditions.

Various other objects and advantages of this invention will be apparent from the following description thereof.

It has now been discovered that by modifying the prior art powdered formulations comprising the inorganic salt carrier, agglomerating agent and fragrance with a polysiloxane and optionally a coupling agent, the resulting products exhibit a broad range of excellent performance characteristics under either dry or moist conditions. Thus, as with the prior products, these modified products exhibit a powdered appearance without being overly dusty, sit on top of the carpet fibers in order to facilitate vacuum removal, provide deodorizing and freshening properties, eliminate mustiness and other disagreeable odors and, optionally, provide anti-static and soil repellent effects. Surprisingly, these products are also highly moisture repellent such that they do not hydrolyze, cake or adhere to the carpet. Rather, these products are readily removable regardless of whether they are applied to dry or moist carpet surfaces. Correspondingly, the efficiency of the vacuum is not diminished by clogging even when the product is removed from a moist area. The products also exhibit extended shelf life in view of their capability to resist the adverse effects of warm, humid conditions. As a further unexpected benefit of the modification treatment, the products retain the fragrance for longer periods of time as a result of a greater capability to maintain fragrance character and intensity. It is clear, therefore, that these novel products maintain the desired properties of the prior art materials while exhibiting a number of unexpected additional performance advantages.

The primary carrier is selected from inorganic salts such as sulfates, chlorides, carbonates, bicarbonates, borates, citrates, phosphates and nitrates. Specific carriers include sodium sulfate, sodium chloride, sodium carbonate, sodium bicarbonate, sodium borate, sodium citrate, sodium tripolyphosphate and sodium nitrate. The basic nature of these salts is that they be capable of existing in agglomerated form so as to facilitate the application of the formulation on to the carpet surface without excessive dusting or uneven distribution and the subsequent removal thereof. Sodium sulfate carrier is the preferred carrier in view of its relatively high density.

Blends of one or more of the above identified carriers can also be used. For example, certain salts can be included so as to contribute to the product density and further facilitate the agglomerate form sitting on the surface of the carpet fibers. Such salts can also aid in absorbing any liquid components of the formulation.

For purposes of this invention, the particle size distribution of the carrier component should be such that substantially all the particles fall within the range 0.06–0.25 mm. (−60+230 U.S. Standard Sieve Series). In this manner, the very fine and very coarse particles which would tend to interfere with the efficient application, retention and removal of the final product are eliminated. Such particle size distribution will generally be attained by the proper choice of salts, although screening of the final product can achieve a comparable result.

The agglomerating agent is incorporated into the formulation in order to affect the physical characteristics of the product by causing agglomeration of the particles. In this manner, the product tends to remain at the point of contact with the carpet surface rather than forming clouds of dust. As a result, neat and uniform distribution is achieved. The agglomerating agent can also function as a means for identifying the treated area of carpet. Typical agglomerating agents include starch, silica powders, grain flours, wood flour, talc, pumice, clays, calcium phosphates, and the like, with starch being the preferred embodiment.

In addition, various liquid, non-fragrant agglomerating agents may also be utilized. These liquids also function as dedusting agents which serve to reduce the incidence of dust in the formulation and thereby insure uniform application and effective removal. Typical agents include alkyl phthalates such as dibutyl phthalate; mineral oils; glycols, ethoxylated alcohols, alcohols; glycol ethers; vegetable oils; naphthas and mineral spirits; and naphthalene sulfonates.

Optionally included are materials which impart anti-static properties and, correspondingly, reduce soil retention and redeposition. Aluminum oxide is the preferred anti-stat, crystalline alumina imparting anti-static properties to both natural and synthetic carpet fibers. In addition, the alumina imparts anti-soil properties which improve the ease of cleaning and maintenance of the carpets. Other applicable anti-static agents include quaternary ammonium chlorides, bromides, or sulfates; cationic quaternary ammonium salts and imidazolium salts; amphoteric tertiary ammonium compounds; nonionic compounds such as tertiary amine oxides, ethoxylated alcohols and alkyl phenols, ethoxylated amines and tertiary phosphine oxides, anionic soaps, sulfate and sulfonates, i.e. fatty acid soaps, ethoxylated alcohols sulfates, sodium alkyl sulfates, alkyl sulfonates, sodium alkyl benzene sulfonates, and sodium or potassium alkyl glyceryl ether sulfonates; and zwitterionic quaternary ammonium compounds.

It is to be noted that known natural and synthetic zeolite materials may be used in the instant formulations to provide anti-static and rheological control properties. Such zeolites will generally be utilized in combination with the aforementioned liquid agglomerating agents to provide good flow properties as well as the anti-stat and soil repellent properties. Zeolites can include synthetic aluminum silicates that may be hydrated of the formula $Na_2O.Al_2O_{3-m}SiO_3.xH_2O$.

All conventional fragrances, i.e. volatile odorous agents, including essential oils, aromatic chemicals and the like, are applicable for use in the instant formulations. A wide variety of such materials is known to those skilled in the perfuming arts. They may compromise one or more natural materials or synthetic aromatic agents or mixtures of the two.

The polysiloxane functions to coat the powder particles, thereby imparting moisture repellent properties and substantially reducing caking potential. The polysiloxanes can be alkyl, alkoxy or aryl substituted polysiloxanes such as methyl hydrogen polysiloxane, dimethyl polysiloxane, phenyl hydrogen polysiloxane and diphenyl polysiloxane. Cyclic polysiloxanes and hydroxylated polysiloxanes can also be utilized. Dimethyl polysiloxane is preferred. Such materials are commercially available, a number being provided by Dow Corning Corporation and General Electric.

It is preferred, although not essential, to utilize the above noted polysiloxanes in conjunction with a coupling agent. These agents function as catalysts to speed and intensify the cure, i.e. crosslinking, of the polysiloxane coating and thereby increase the water repellent and fragrance retention properties. The preferred coupling agents are organofunctional silane monomers which are seen to possess both organic and inorganic reactivity. Typical organic functional groups include amine, alkylamino, alkoxy, methacrylate, epoxy, mercapto and haloalkyl groups. The aminoalkyl and alkoxy functional silanes are preferred.

With regard to relative concentrations, the carrier will generally be present in a range of from about 40.0–98.94%; the agglomerating agent in a range of from about 1.0–25.0%; the anti-static agent in a range of from about 0–15.0%; the fragrance in a range of from about 0.01–18.0%; and the polysiloxane in a range of from about 0.05–2.0%, as based on the weight of the total composition. When a liquid agglomerating (dedusting) agent is utilized, the combined concentration of the agent and the fragrance should preferably not exceed about 5% by weight. Excessive concentrations tend to increase the adherence of dirt to the carpet fibers as well as to cause excessive agglomeration thereby reducing the ease of application and dispersal. The coupling agent, when utilized, is present at from about 3–15%, by weight of the polysiloxane level, and preferably about 10%, by weight. Preferred concentrations, by weight, are as follows: 75.0–95.5% carrier, 2.0–10.0% agglomerating agent, 1.0–7.0% anti-static agent, 0.5–2.5% fragrance, 0.1–1.0% polysiloxane.

The instant formulations can be prepared by any conventional blending technique in any addition sequence when the coupling agent is absent, it being required that a substantially uniform coating of polysiloxane is obtained. The preferred sequence and the sequence to be utilized when a coupling agent is present involves pre-blending the polysiloxane and fragrance; pre-blending the coupling agent and liquid agglomerating agent, if present; blending the carrier, agglomerating agent and anti-static agent, if present, in a high shear blender; spraying the polysiloxane-fragrance pre-blend onto the powders to obtain uniform distribution; and spraying the coupling agent pre-blend onto the resulting blend. Subsequent curing occurs at room temperature or at elevated temperatures if the coupling agent is not utilized. If needed, the final product can be screened to remove undesirable fines and/or lumps. The final product will generally exhibit an agglomerated, substantially dust-free appearance and can be readily applied to the carpet by means of any conventional shaking or dusting technique.

The following examples will further illustrate the embodiments of this invention. In these examples, all parts given are by weight unless otherwise noted.

EXAMPLE 1

This example illustrates the preparation of a typical composition of the instant invention.

The following component blend was utilized:

| | parts |
|---|---|
| sodium sulfate | 67.65 |
| sodium bicarbonate | 22.00 |
| corn starch | 5.00 |
| aluminum oxide | 3.00 |
| fragrance | 1.00 |
| mineral oil | 0.80 |
| dimethyl polysiloxane | 0.50 |
| N—(β-aminoethyl)-γ-aminopropyl-trimethoxysilane | 0.05 |

The composition was prepared by pre-mixing (1) the polysiloxane and fragrance, (2) the silane and mineral oil, and (3) the sulfate, bicarbonate, starch and aluminum oxide. Pre-blend (3) was mixed for 3.5 minutes whereupon pre-blend (1) was sprayed thereon. Blending continued for one minute. Finally, pre-blend (2) was sprayed on the blend and allowed to mix for an additional three minutes. An agglomerated, substantially dust-free product was obtained utilizing this formulation and utilizing a carrier system having a particle size range of 0.06–0.25 mm.

The product was then sprinkled onto a soiled carpet having both dry and wet areas. It was observed that the product contacted the carpet surface with a minimum amount of dusting. The product was allowed to remain in contact with the carpet fibers for a period of three minutes and then removed by vacuuming. The vacuuming operation proceeded quickly and efficiently from both the dry and wet areas. The carpet was observed to have a pleasant, residual odor. Observations over a period of one month revealed the existence of anti-static and anti-resoiling characteristics. Observation of the formulation over the same one month period revealed good shelf life and the maintenance of fragrance.

EXAMPLE II

The general procedure of Example I is applicable for preparing the following formulations:

| | 2 | 3 | 4 | 5 | 6 | 7 | 8 | 9 | 10 | 11 | 12 | 13 | 14 |
|---|---|---|---|---|---|---|---|---|---|---|---|---|---|
| Sodium Sulfate | 67.67 | 67.12 | 66.90 | 68.17 | 67.95 | 67.92 | 67.40 | 68.67 | 68.45 | 68.12 | 67.90 | 69.90 | 70.90 |
| Sodium Bicarbonate | 22.00 | 22.00 | 22.00 | 22.00 | 22.00 | 22.00 | 22.00 | 22.00 | 22.00 | 22.00 | 22.00 | 22.00 | 22.00 |
| Corn Starch | 5.00 | 5.00 | 5.00 | 5.00 | 5.00 | 5.00 | 5.00 | 5.00 | 5.00 | 5.00 | 5.00 | 5.00 | 5.00 |
| Aluminum Oxide | 3.00 | 3.00 | 3.00 | 3.00 | 3.00 | 3.00 | 3.00 | 3.00 | 3.00 | 3.00 | 3.00 | — | — |
| Fragrance | 1.00 | 1.00 | 1.00 | 1.00 | 1.00 | 1.00 | 1.00 | 1.00 | 1.00 | 1.00 | 1.00 | 1.00 | 1.00 |
| Mineral Oil | 1.00 | 1.00 | 1.00 | 0.50 | 0.50 | 0.50 | 0.50 | — | — | — | — | 1.00 | — |
| Dimethyl Polysiloxane | 0.30 | 0.80 | 1.00 | 0.30 | 0.50 | 0.80 | 1.00 | 0.30 | 0.50 | 0.80 | 1.00 | 1.00 | 1.00 |
| N—(β-aminoethyl)-γ-aminopropyl-trimethoxysilane | 0.03 | 0.08 | 0.10 | 0.03 | 0.05 | 0.08 | 0.10 | 0.03 | 0.05 | 0.08 | 0.10 | 0.10 | 0.10 |

The physical appearance and performance characteristics of these formulations will be generally comparable to that of the formulation of Example I.

EXAMPLE III

This example illustrates the unexpected increased fragrance retention capability of the instant formulations.

The following formulations were prepared according to the procedure of Example I. The controls, i.e. the samples without the silicone components, were prepared by blending the fragrance and mineral oil with a blend of the solid materials.

| | parts | | | | | |
|---|---|---|---|---|---|---|
| | 15 | 16 | 17 | 18 | 19 | 20 |
| sodium sulfate | 67.65 | 68.2 | 67.65 | 68.2 | 67.65 | 68.2 |
| sodium bicarbonate | 22.0 | 22.0 | 22.0 | 22.0 | 22.0 | 22.0 |
| corn starch | 5.0 | 5.0 | 5.0 | 5.0 | 5.0 | 5.0 |
| aluminum oxide | 3.0 | 3.0 | 3.0 | 3.0 | 3.0 | 3.0 |
| mineral oil | 0.8 | 0.8 | 0.8 | 0.8 | 0.8 | 0.8 |
| dimethyl polysiloxane | 0.5 | — | 0.5 | — | 0.5 | — |
| N—(β-aminoethyl)-γ-aminopropyl-trimethoxysilane | 0.05 | — | 0.05 | — | 0.05 | — |
| herbaceous pine fragrance | 1.0 | 1.0 | — | — | — | — |
| modified lavendin/lavender fragrance | — | — | 1.0 | 1.0 | — | — |
| lavender fragrance | — | — | — | — | 1.0 | 1.0 |

The formulations were then tested by (1) storing samples at room temperature, 44° C. and 55° C.; (2) extracting the fragrance oils from specimens of the samples at varying time intervals; and (3) determining the fragrance level by infrared spectrophotometry. The following results were obtained:

| | | Fragrance Conc. (%) | | | |
|---|---|---|---|---|---|
| Formulation | Temp (°C.) | Orig. | 7 wks | 13 wks | 24 wks |
| 15 | RT | 0.97 | 0.92 | 0.90 | 0.92 |
| 16 | RT | 0.89 | 0.82 | 0.80 | 0.75 |
| 17 | RT | 0.91 | 0.87 | 0.88 | 0.82 |
| 18 | RT | 0.85 | 0.76 | 0.74 | 0.67 |
| 19 | RT | 1.04 | 0.96 | 0.99 | 0.88 |
| 20 | RT | 0.87 | 0.74 | 0.73 | 0.66 |
| 15 | 44 | 0.97 | 0.74 | 0.67 | 0.46 |

-continued

| | | Fragrance Conc. (%) | | | |
|---|---|---|---|---|---|
| Formulation | Temp (°C.) | Orig. | 7 wks | 13 wks | 24 wks |
| 16 | 44 | 0.89 | 0.52 | 0.48 | 0.33 |
| 17 | 44 | 0.91 | 0.72 | 0.47 | 0.29 |
| 18 | 44 | 0.85 | 0.54 | 0.37 | 0.25 |
| 19 | 44 | 1.04 | 0.70 | 0.50 | 0.36 |
| 20 | 44 | 0.87 | 0.48 | 0.41 | 0.22 |
| 15 | 55 | 0.97 | 0.57 | — | — |
| 16 | 55 | 0.89 | 0.39 | — | — |
| 17 | 55 | 0.91 | 0.48 | — | — |
| 18 | 55 | 0.85 | 0.33 | — | — |
| 19 | 55 | 1.04 | 0.48 | — | — |
| 20 | 55 | 0.87 | 0.35 | — | — |

These data thus indicate the increased fragrance retention capability of the instant formulations.

Summarizing, it is seen that this invention provides an improved carpet treating composition which exhibits a broad range of deodorizing characteristics. Variations may be made in proportions, procedures and materials without departing from the scope of the invention as defined by the following claims.

What is claimed is:

1. A powdered carpet-treating composition comprising a blend of from about 40.0–98.94%, by weight, of an inorganic salt carrier selected from the group consisting of sulfates, chlorides, carbonates, bicarbonates, borates, citrates, phosphates, nitrates and blends thereof, substantially all of the particles of said carrier being between 0.06–0.25 millimeters; from about 1.0–25.0%, by weight, of an agglomerating agent; from about 0–15.0% by weight, of an antistatic agent; from about 0.01–18.0%, by weight, of a volatile odorous agent; and from about 0.5–2.0% by weight, of a polysiloxane.

2. The composition of claim 1, wherein said carrier is sodium sulfate and said agglomerating agent is starch.

3. The composition of claim 2, wherein said carrier is a blend of sodium sulfate and sodium bicarbonate.

4. The composition of claim 1, wherein the antistatic agent is present and is aluminum oxide.

5. The composition of claim 3, wherein the antistatic agent is present and is aluminum oxide.

6. The composition of claim 1, wherein said agglomerating agent is a solid material and is selected from the group consisting of starch, silica powders, grain flour, wood flours, talc, pumice, clays and calcium phosphate.

7. The composition of claim 1, wherein said agglomerating agent is a liquid material selected from the group consisting of alkyl phthalates, mineral oil, glycols, ethoxylated alcohols, alcohols, glycol ethers, vegetable oils, naphthas and mineral spirits; the combined concentration of said liquid agglomerating agent and said odorous agent ranging up to about 5.0% by weight.

8. The composition of claim 7, wherein said liquid agglomerating agent is mineral oil.

9. The composition of claim 1, wherein said polysiloxane is selected from the group consisting of alkyl-substituted, alkoxy-substituted, aryl-substituted, cyclic and hydroxylated polysiloxanes.

10. The composition of claim 9, wherein said polysiloxane is dimethyl polysiloxane.

11. The composition of claim 1, which also contains from about 3 to 15%, by weight of the polysiloxane, of a coupling agent for said polysiloxane.

12. The composition of claim 11, wherein said coupling agent is an organofunctional silane monomer.

13. The composition of claim 12, wherein said organofunctional group is selected from the group consisting of amine, alkylamino, alkoxy, methacrylate, epoxy, mercapto and haloalkyl groups.

14. The composition of claim 13, wherein said silane is an aminoalkyl functional silane.

15. The composition of claim 12, wherein said polysiloxane is dimethylsiloxane and said silane monomer is N-($\beta$-aminoethyl)-$\gamma$-aminopropyltrimethoxysilane.

16. The composition of claim 15, wherein the concentration of said silane is 10% by weight of the concentration of said polysiloxane.

17. The composition of claim 12, wherein said composition comprises, by weight, 67.65% sodium sulfate, 22.00% sodium bicarbonate, 5.00% corn starch, 3.00% aluminum oxide, 1.00% fragrance, 0.80% mineral oil, 0.50% dimethyl polysiloxane and 0.05% N-($\beta$-aminoethyl)-$\gamma$-aminopropyltrimethoxysilane.

18. A method for treating natural and synthetic carpets so as to impart deodorizing and air freshening characteristics thereto which comprises applying to the carpet surface, in powdered form, an effective amount of the formulation according to claim 1, and thereafter removing said composition.

19. A method for treating natural and synthetic carpets so as to impart deodorizing and air freshening characteristics thereto which comprises applying to the carpet surface, in powdered form, an effective amount of the formulation according to claim 12, and thereafter removing said composition.

20. A method for treating natural and synthetic carpets so as to impart deodorizing, air freshening antistatic and anti-soil redeposition characteristics thereto which comprises applying to the carpet surface, in powdered form, an effective amount of the formulation according to claim 17, and thereafter removing said composition.

* * * * *